US008070495B2

(12) United States Patent
Fan et al.

(10) Patent No.: US 8,070,495 B2
(45) Date of Patent: Dec. 6, 2011

(54) ELECTRICAL CONNECTOR ASSEMBLY AND BACK PLATE ARRANGEMENT THEREOF

(75) Inventors: Chia-Wei Fan, Tu-Cheng (TW); Nan-Hung Lin, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 316 days.

(21) Appl. No.: 12/495,693

(22) Filed: Jun. 30, 2009

(65) Prior Publication Data

US 2009/0325395 A1 Dec. 31, 2009

(30) Foreign Application Priority Data

Jun. 30, 2008 (TW) ..... 97211554 U

(51) Int. Cl.
*H01R 12/00* (2006.01)

(52) U.S. Cl. ..... 439/61; 439/331

(58) Field of Classification Search ..... 439/61, 439/331, 342, 70, 71, 487, 73; 361/719, 361/720, 770, 803, 807–810; 174/177
See application file for complete search history.

(56) References Cited

U.S. PATENT DOCUMENTS

| | | | | |
|---|---|---|---|---|
| 6,109,930 | A * | 8/2000 | Koschmeder et al. | 439/74 |
| 6,697,263 | B2 | 2/2004 | Szu | |
| 6,935,868 | B1 * | 8/2005 | Campini et al. | 439/67 |
| 7,341,460 | B1 * | 3/2008 | McHugh et al. | 439/71 |

* cited by examiner

*Primary Examiner* — Tulsidas C Patel
*Assistant Examiner* — Travis Chambers
(74) *Attorney, Agent, or Firm* — Wei Te Chung; Andrew C. Cheng; Ming Chieh Chang

(57) ABSTRACT

An electrical connector assembly (1) mounted on a printed circuit board (4) includes at least two electrical connectors (2) located on one side of the printed circuit board (4) and a back plate arrangement (3) located on the other side of the printed circuit board (4) opposite to the electrical connectors (2). The back plate arrangement (3) secures the electrical connectors (2) onto the printed circuit board (4), and includes at least two back plates (30) and at least one connecting bridge (31) interconnecting the at lest two back plates (30).

16 Claims, 5 Drawing Sheets

ELECTRICAL CONNECTOR ASSEMBLY AND BACK PLATE ARRANGEMENT THEREOF

BACKGROUND OF THE INVENTION

1. Field of the Invention

The present invention relates to an electrical connector assembly and a back plate arrangement used in the assembly, and more particularly to an electrical connector assembly including at least two electrical connectors and a back plate arrangement employed to retain the electrical connectors.

2. Description of Prior Art

A central processing unit (CPU) in a computer is generally mounted onto a printed circuit board (PCB) via an electrical connector so as to obtain electrical communication therebetween. To more stably retain the electrical connector, a back plate is usually utilized to be mounted onto one side of the PCB opposite to the electrical connector and fasteners such as screws are then used to bolt down the electrical connector with the PCB and the back plate. To meet the trend of high performance of a computer, two or more CPUs are adopted to work in same computer, and correspondingly, two or more electrical connectors are needed. However, separate back plates which respectively retain one connector, are spaced from each other and is likely to apply an uneven force to the PCB and may further cause deformation of the PCB.

As above descried disadvantage of a conventional back plate arrangement, a new type of back plate is developed, which is formed as an integral one capable of retaining two or more connectors. This type of back plate will not damage the PCB because of its larger surface. However, since the dimension between the threaded holes on the back plate for different connectors is predetermined and not changeable, the distance between two neighboring connectors is limited. Namely, if the connector arrangement, especially the dimension between the connectors is changed, the original back plate should be also replaced by a new one. Therefore the cost thereof is increased.

Thus, there is a need to provide a new electrical connector assembly and a relative back plate arrangement that overcome the above-mentioned problems.

SUMMARY OF THE INVENTION

It is therefore the object of the present invention to provide an electrical connector assembly with adjustable dimension between neighboring electrical connectors and a back plate arrangement used in the electrical connector assembly.

In accordance with the present invention, an electrical connector assembly mounted on a printed circuit board is provided, which includes at least two electrical connectors located on one side of the printed circuit board and a back plate arrangement located on the other side of the printed circuit board opposite to the electrical connectors. The back plate arrangement secures the electrical connectors onto the printed circuit board, and includes at least two back plates and at least one connecting bridge interconnecting the at lest two back plates.

BRIEF DESCRIPTION OF THE DRAWINGS

Other objects, advantages and novel features of the present invention will become more apparent from the following detailed description when taken in conjunction with the accompanying drawings, in which.

DETAILED DESCRIPTION OF PREFERRED EMBODIMENT

Figure 1:
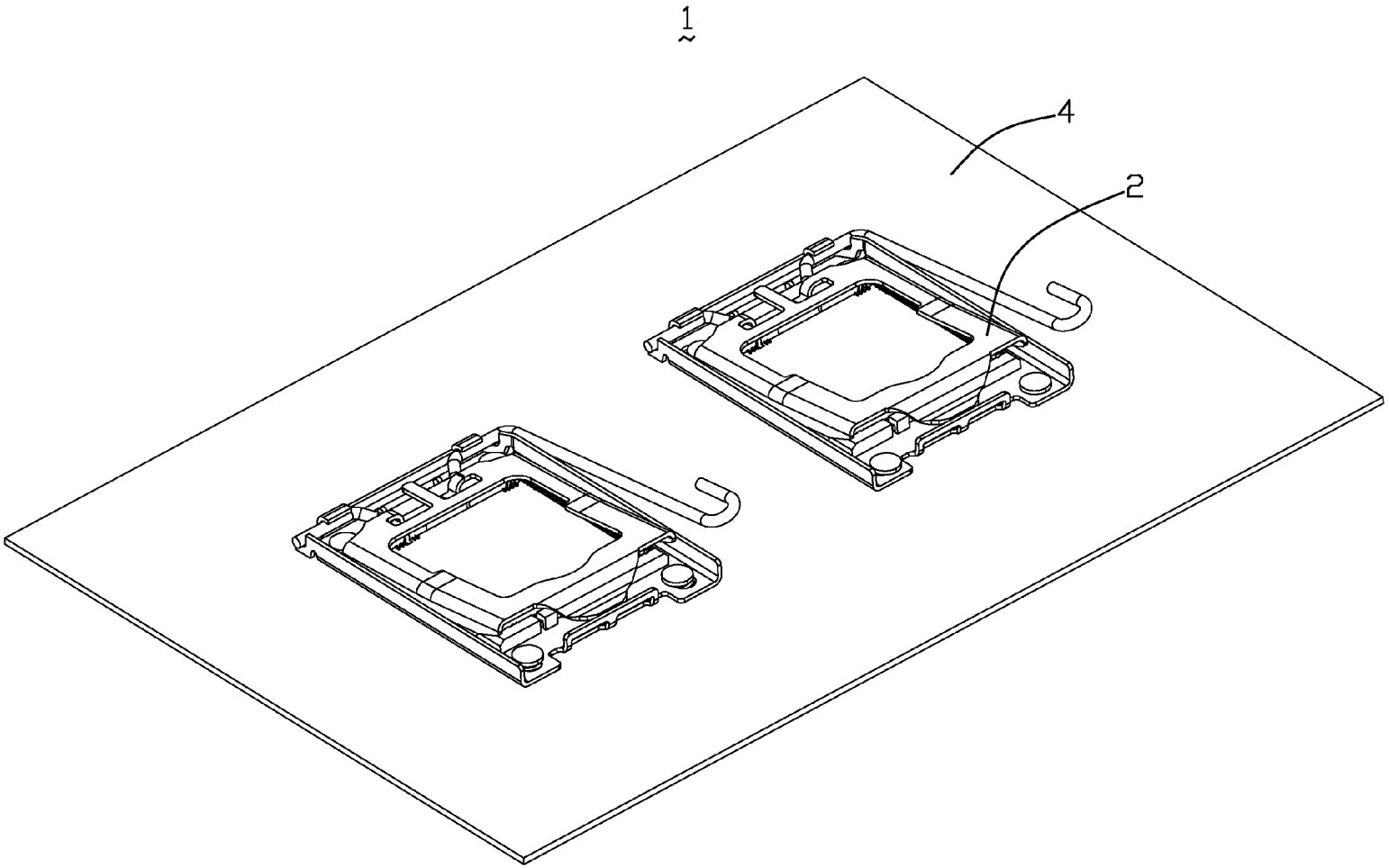
FIG. 1 is an assembled, perspective view of an electrical connector assembly mounted on a printed circuit board in accordance with a preferred embodiment of the present invention.
Figure 2:
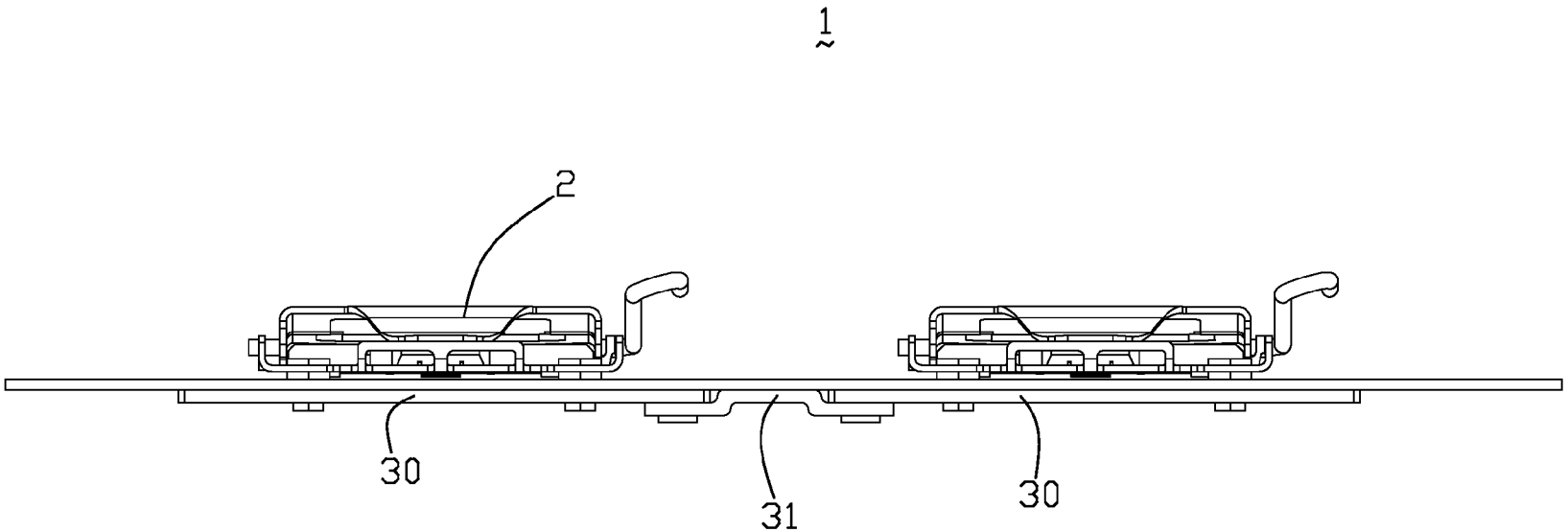
FIG. 2 is a side view of FIG. 1.
Figure 3:
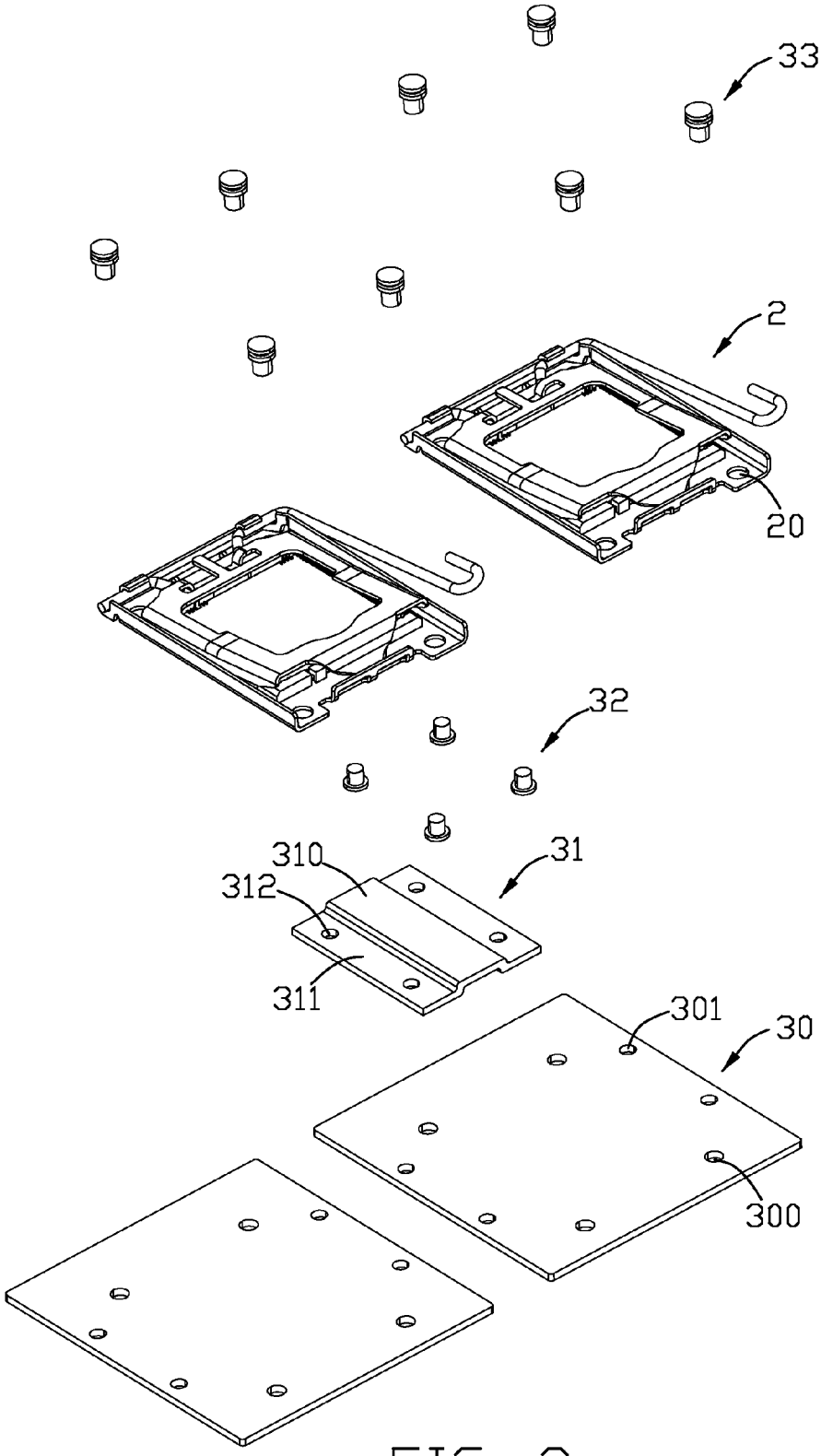
FIG. 3 is an exploded, perspective view of the electrical connector assembly shown in FIG. 1.
Figure 4:
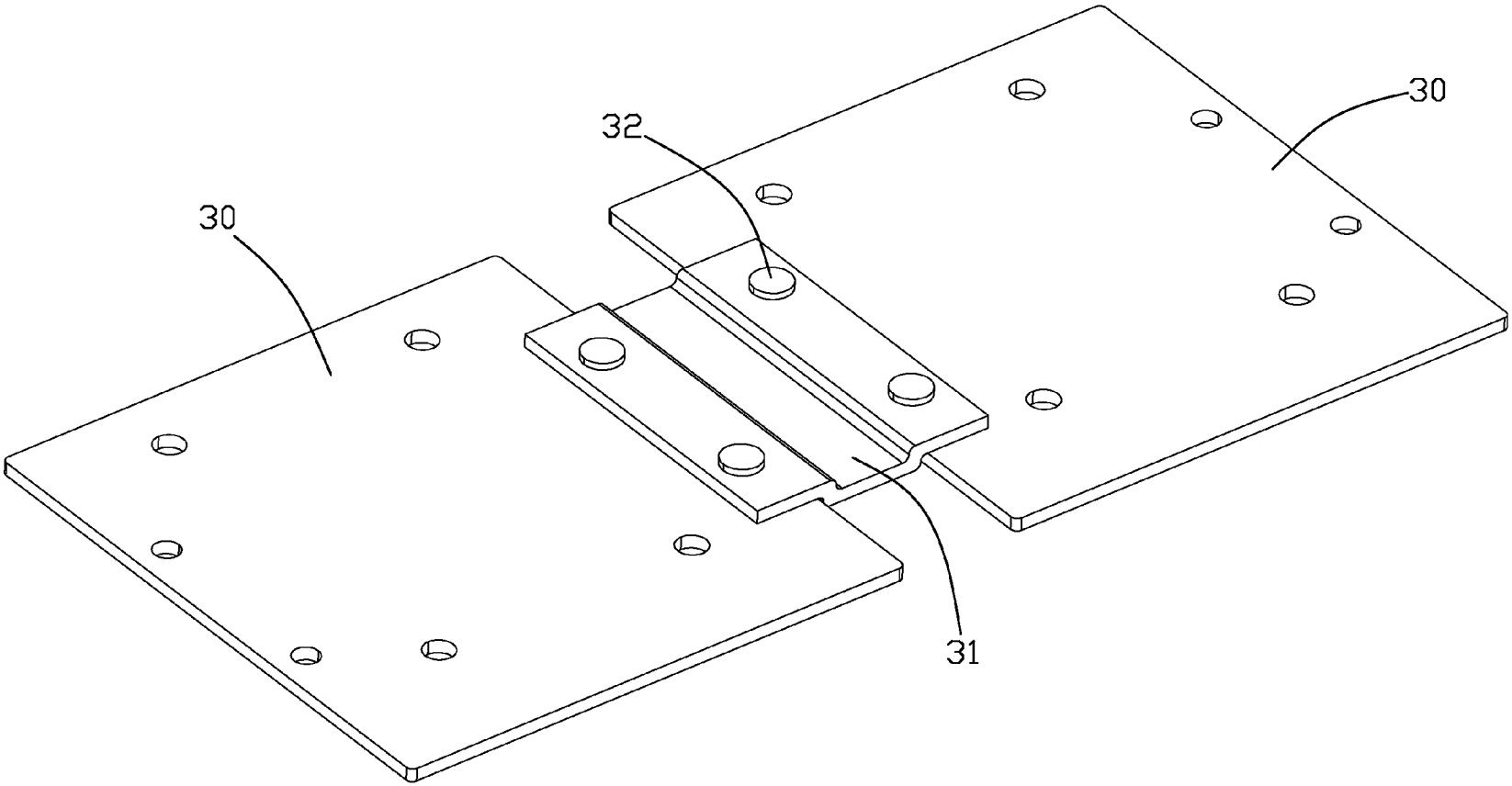
FIG. 4 is an assembled, perspective view of a back plate arrangement in accordance with the preferred embodiment of the present invention.
Figure 5:
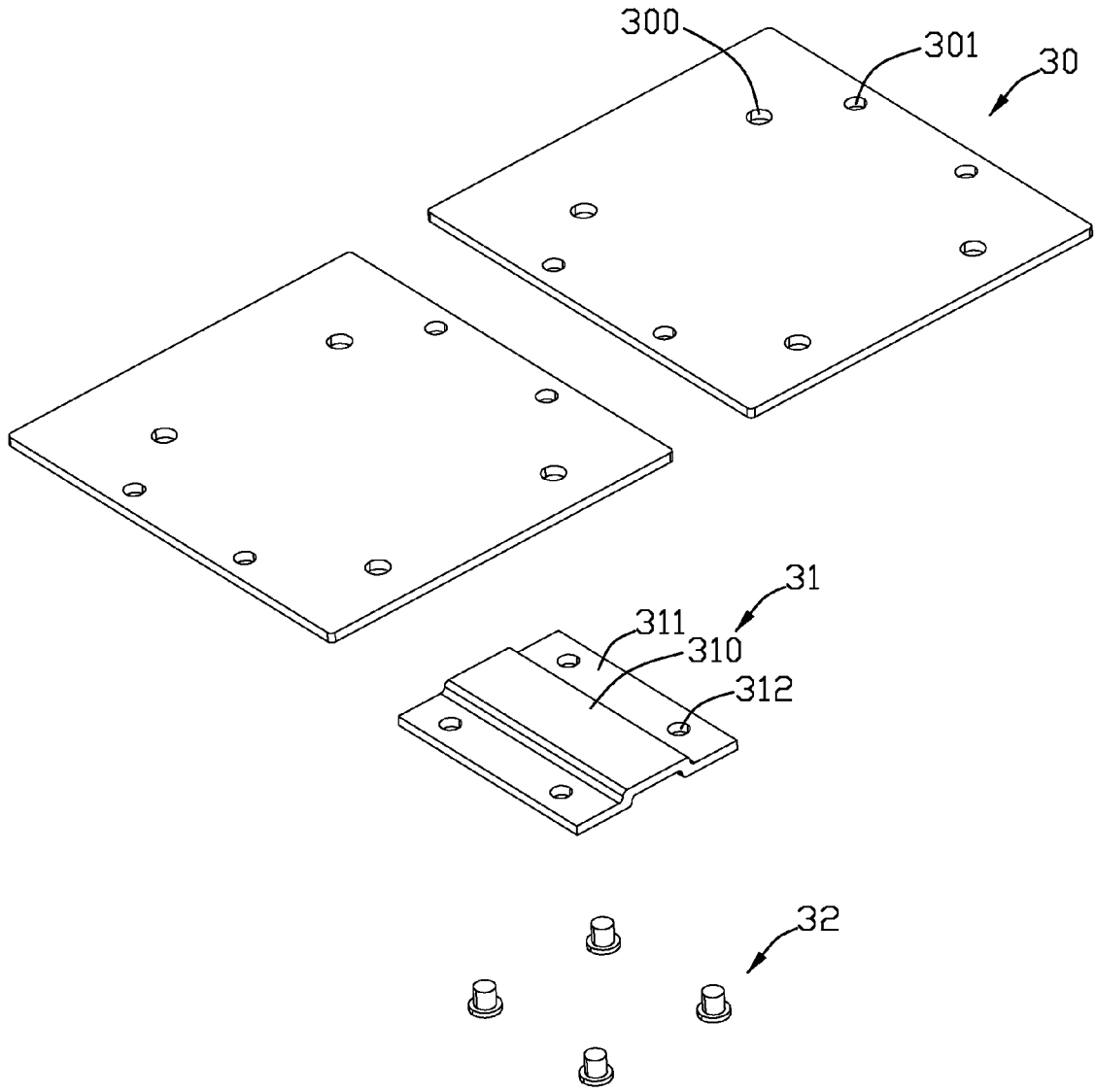
FIG. 5 is an exploded, perspective view of the back plate arrangement shown in FIG. 4.

FIGS. 1-5 illustrate an electrical connector assembly 1 made in accordance with a preferred embodiment of the present invention. The electrical connector assembly 1 is mounted onto a printed circuit board 4 and includes a pair of electrical connectors 2 located on one side of the printed circuit board 4 and a back plate arrangement 3 located on the other side of the printed circuit board 4 opposite to the electrical connectors 2. The back plate arrangement 3 includes a pair of back plate 30 and a connecting bridge 31 interconnecting the two back plates 30.

The electrical connector 2 is configured with four through holes 20 at four corners thereof, and the back plate 30 is correspondingly configured with threaded holes 300 aligning with the through holes 20. In addition, each back plate 30 defines a pair of opposite edges respectively configured with a pair of connecting holes 301.

The connecting bridge 31 is stamped from a metal sheet and includes a pair of connecting sections 311 spaced from each other and an elevated section 310 between the pair of the connection sections 311. The elevated section 310 extends toward and abuts against the printed circuit board 4 so as to prevent deformation of the printed circuit board 4. Each connecting section 311 defines a pair of retaining holes 312.

When assembling the back plate arrangement 3, the elevated section 310 of the connecting bridge 31 is placed between the pair of the back plates 30 and the connecting sections 311 are located under the back plates 30. The retaining holes 312 of the connecting bridge 31 are aligning with the connecting holes 301 of the back plates 30, and then a first set of screws 32 pass the retaining holes 312 and the connecting holes 301 such that the back plates 30 and the connecting bridge 31 are locked together.

When securing the electrical connectors 2 onto the printed circuit board 4, firstly dispose the electrical connectors 2 at predetermined positions upon the printed circuit board 4 with a second set of screws 33 passing the through holes 20 of the electrical connectors 2 and corresponding holes (not shown) on the printed circuit board 4. Secondly, place the back plate arrangement 3 under the printed circuit board 4 with the threaded holes 300 aligning with the second set of screws 33, and then rotate the screws 33 to lock into the threaded holes 300 so that the electrical connectors 2 could be fastened on the printed circuit board 4.

When the distance between the two electrical connectors 2 needs to be changed, only the connecting bridge 31 is required to be replaced with another one of a different dimension, while the back plates 30 do not need to be changed. Thus, compared to prior arts described before, the back plate arrangement 3 is more economic. Moreover, since the back plates 30 are combined with a connection member 31 such that a continuous big area is provided to engage the printed circuit board 4 and thus the deformation of the circuit board 4 is efficiently prevented.

The back plate arrangement of the present invention could also be expanded to have three or more back plates arranged in a line, in which more connecting bridges are needed. In addition, the connecting bridge is also able to be configured with four connecting sections at periphery edges with an elevated section therebetween such that four back plates should be connected to a same connecting bridge simultaneously.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector assembly mounted on a printed circuit board comprising:

at least two electrical connectors located on one side of the printed circuit board;

and a back plate arrangement located on the other side of the printed circuit board opposite to the electrical connectors and securing the electrical connectors onto the printed circuit board, the back plate arrangement comprising at least two back plates and at least one connecting bridge interconnecting said at lest two back plates.

2. The electrical connector assembly as claimed in claim 1, wherein the connecting bridge comprising a pair of connecting sections and an elevated section therebetween extending toward the printed circuit board and abutting against the printed circuit board.

3. The electrical connector assembly as claimed in claim 1, further comprising a second set of screws passing through the back plates and the printed circuit board, and then engaging with the electrical connectors.

4. The electrical connector assembly as claimed in claim 1, further comprising a first set of screws to fasten the connecting bridge and the back plates with each other.

5. The electrical connector assembly as claimed in claim 4, wherein the back plate defines a pair of opposite edges, both of which are configured with connecting holes engaging with said first set of screws.

6. A back plate arrangement for cooperating with a circuit board to secure an electrical connector assembly comprising:

at least two back plates; and at least one connecting bridge interconnecting said at lest two back plates.

7. The back plate arrangement as claimed in claim 6, wherein the connecting bridge comprising a pair of connecting sections and an elevated section therebetween extending toward the printed circuit board and abutting against the printed circuit board.

8. The back plate arrangement as claimed in claim 7, further comprising a plurality of screws engaging with the connecting bridge and the back plates.

9. The back plate arrangement as claimed in claim 8, wherein said at least two back plates are spaced from each other by the elevated section of the connecting bridge.

10. The back plate arrangement as claimed in claim 9, wherein the back plate defines a pair of opposite edges, both of which are configured with connecting holes engaging with the screws.

11. A connector assembly comprising:

a printed circuit board defining opposite upper and bottom surfaces;

a pair of connectors mounted upon two spaced areas on the upper surface;

a pair of back plates positioned upon the bottom surface in vertical alignment with the corresponding connectors, respectively; and a connecting bridge positioned upon the bottom surface and linked between said pair of back plates.

12. The connector assembly as claimed in claim 11, wherein said back plates are fastened to both said printed circuit board and the corresponding connectors, respectively.

13. The connector assembly as claimed in claim 11, wherein said connecting bridge is discrete from but fastened to said back plates.

14. The connector assembly as claimed in claim 11, wherein said connecting bridge is not directly fastened to the printed circuit board.

15. The connector assembly as claimed in claim 11, wherein connecting bridge includes an elevated section abutting against the bottom surface.

16. The connector assembly as claimed in claim 15, wherein said connecting bridge further includes a connection section to cooperate with the printed circuit board to sandwich the corresponding back plate therebetween in a vertical direction.

* * * * *